US006921355B2

(12) United States Patent
Campanaro et al.

(10) Patent No.: US 6,921,355 B2
(45) Date of Patent: Jul. 26, 2005

(54) EXERCISE DEVICE

(75) Inventors: Thomas J. Campanaro, Rancho Santa Fe, CA (US); Larry Westfall, San Diego, CA (US); Dale Mc Murray, San Diego, CA (US)

(73) Assignee: Engineering Fitness International, San Diego, CA (US)

( * ) Notice: Subject to any disclaimer, the term of this patent is extended or adjusted under 35 U.S.C. 154(b) by 344 days.

(21) Appl. No.: 10/376,044

(22) Filed: Feb. 26, 2003

(65) Prior Publication Data

US 2004/0166998 A1 Aug. 26, 2004

(51) Int. Cl.[7] ..... A63B 21/068

(52) U.S. Cl. ..... 482/95; 482/103; 482/135; 482/138; 482/140; 482/141; 482/145

(58) Field of Search ..... 482/72, 92–96, 482/103, 121–123, 126, 131, 132, 135, 138, 140, 141, 142, 145; D21/676

(56) References Cited

U.S. PATENT DOCUMENTS

| | | | | | |
|---|---|---|---|---|---|
| 3,770,267 | A | * | 11/1973 | McCarthy | 482/130 |
| 3,892,404 | A | * | 7/1975 | Martucci | 482/96 |
| 4,004,801 | A | | 1/1977 | Campanaro et al. | |
| 4,383,684 | A | * | 5/1983 | Schliep | 482/96 |
| 4,911,438 | A | * | 3/1990 | Van Straaten | 482/96 |
| 5,169,363 | A | | 12/1992 | Campanaro et al. | |
| 5,620,403 | A | * | 4/1997 | Lundin | 482/96 |
| D405,132 | S | | 2/1999 | Westfall et al. | |
| 5,906,564 | A | * | 5/1999 | Jacobsen | 482/96 |
| 5,938,571 | A | * | 8/1999 | Stevens | 482/96 |
| 5,967,955 | A | | 10/1999 | Westfall et al. | |
| 6,024,677 | A | * | 2/2000 | Siwertz | 482/96 |
| 6,527,685 | B2 | * | 3/2003 | Endelman et al. | 482/121 |
| 6,634,996 | B2 | * | 10/2003 | Jacobsen | 482/96 |
| 6,692,412 | B2 | * | 2/2004 | Chen et al. | 482/96 |
| 6,767,314 | B2 | * | 7/2004 | Thompson | 482/96 |
| D493,853 | S | * | 8/2004 | Campanaro et al. | D21/676 |
| 2003/0119635 | A1 | * | 6/2003 | Arbuckle et al. | 482/142 |
| 2004/0142800 | A1 | * | 7/2004 | Gerschefske | 482/142 |

* cited by examiner

*Primary Examiner*—Jerome W. Donnelly
*Assistant Examiner*—Victor K. Hwang
(74) *Attorney, Agent, or Firm*—Stephen C. Beuerle; Procopio Cory Hargreaves & Savitch LLP

(57) ABSTRACT

A collapsible exercise device includes a vertical support member, first and second sets of rails pivotally connected to each other, and a strut interconnecting the vertical support member and the rails. A user support platform engages the rails. First and second combination pulley-support and pull-up bars are pivotally connected to the first end of the first set of rails for movement between at least a substantially vertical position and a substantially horizontal position. First and second pulleys are slidably connected to bars and receive a cable, which is also connected to the user support platform. The exercise device is foldable such that the vertical support member, the rails and the strut are substantially parallel to each other; and the rails are extendable from the vertical support member and are alignable such that the user support platform is rollable along the first and second pulleys.

12 Claims, 15 Drawing Sheets

110
830
940
100
B
700
1000
320
120
230
260
620
240

710
720
740
730
750
780
770
700
820
790
800
810

EXERCISE DEVICE

FIELD OF THE INVENTION

The present invention relates to an exercise device. More particularly, the present invention relates to an exercise device wherein the exerciser exerts muscle force against an adjustable portion of the exerciser's own body weight.

BACKGROUND OF THE INVENTION

Home exercise is becoming increasingly more popular. Home exercise offers the health benefits of regular exercise while recognizing that many people have difficulty in finding sufficient time in their schedule for a full workout at a health club or gymnasium. An exerciser may exercise at home whenever the exerciser's schedule permits. This flexibility in scheduling often allows for a more consistent and thus healthful exercise regime.

Home exercise, however, has its drawbacks. In particular, in order to exercise all or most of the muscle groups, multiple pieces of home exercise equipment may be required. Furthermore, these multiple pieces of equipment may require permanent installation in the exerciser's home.

Permanent or not, many popular pieces of home exercise equipment occupy a great deal of space. This makes the use of this equipment impractical in homes or apartments which do not have the required extra space. Furthermore, non-permanent pieces of equipment are often difficult to disassemble and may require much storage space even when disassembled. A user must then often choose between an exercise device providing a complete exercise regime and a device which fits the exerciser's home space.

There is, thus, a need for exercise equipment which may be easily stored when not in use, does not occupy a great deal of space when in use and provides for exercising all or most of the muscle groups.

Exercise devices are known in which a user, positioned on a support platform, propels that support platform up an inclined ramp. One way by which the platform may be propelled is by pulling a cable connected to the support platform through a variety of pulleys positioned on the exercise device. By changing positions on the platform and by changing the method by which the platform is propelled, a user can exercise multiple muscle groups.

While early versions of these devices did not allow for easy storage, later designs were proposed that allowed for some type of disassembly in the design. Even the later designs do not, however, provide complete foldability of the exercise unit. The designs include some separate elements which must be disengaged to allow for foldability of the device. Thus, these designs cannot be folded and stored as a unit. Moreover, the designs are not easily converted from the folded stored state to an unfolded state for use.

Another problem with early versions of these devices is that they did not allow for a wide variety of different types of muscle exercises, especially multiple muscle exercises for each specific muscle group.

In view of the foregoing, there is a need for an inclined ramp exercise device which is easily foldable to a size which allows for easy storage, is easily unfolded into a useable state, and which allows for exercising multiple muscle groups and multiple exercises for each muscle group.

SUMMARY OF THE INVENTION

Accordingly, the present invention is directed to an exercise device that substantially obviates one or more or the problems due to limitations and disadvantages of the related art.

An aspect of the invention involves a collapsible exercise device including a vertical support member, and first and second sets of rails each having a first end and a second end. The first ends of the first set of rails are pivotally connected to, and adjustably supported by, the vertical support member. The first ends of the second set of rails are pivotally connected to the second end of the first set of rails. A strut includes a first end pivotally connected to the vertical support member and a second end pivotally connected to the rails where the rails are pivotally connected to each other. A user support platform with rollers engages the first and second set of rails. First and second combination pulley-support and pull-up bars are each pivotally connected to the first end of the first set of rails for movement between at least a substantially vertical position and a substantially horizontal position where the combination pulley-support and pull-up bars are used for performing pull-ups. First and second pulleys are slidably connected to bars. A cable extends through the first and second pulleys and is connected to the user support platform. The exercise device is foldable such that the vertical support member, the first set of rails, the second set of rails and the strut are substantially parallel to each other; and the first and second set of rails are extendable from the vertical support member and are alignable such that the user support platform is rollable along the first and second pulleys.

In further implementations of the above aspect of the invention, the collapsible exercise device may include one or more of the following: a folding squat platform pivotally and removably connected to the second end of the second set of rails and a squat stand telescopingly and removably engaged with the folding squat platform; a push-up bar removably connected to the second end of the second set of rails; a padded foot support removably connected to the second end of the second set of rails; a dip bar assembly connected to the second set of rails, and the dip bar assembly including a pair of dip bars movable between at least a retracted, out-of-the way position, and a non-retracted, ready-for-use position; a foot support assembly pivotally connected to the first set of rails, and the foot support assembly pivotable between at least a retracted, out-of-the way position, and a non-retracted, ready-for-use position; and the vertical support member includes a vertical support tower including opposite sides with tower level tracks therein, the tower level tracks including multiple vertically spaced hooks, the first end of each of the first set of rails being pivotally connected to, and adjustably supported by opposite hooks of the tower level tracks.

It is understood that both the foregoing general description and following detailed description are exemplary and explanatory and are intended to provide further explanation to the invention as claimed. The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

FIGS. 5C and 5D illustrate an embodiment of a telescoping toe bar accessory

DETAILED DESCRIPTION OF PREFERRED EMBODIMENTS

Figure 1:
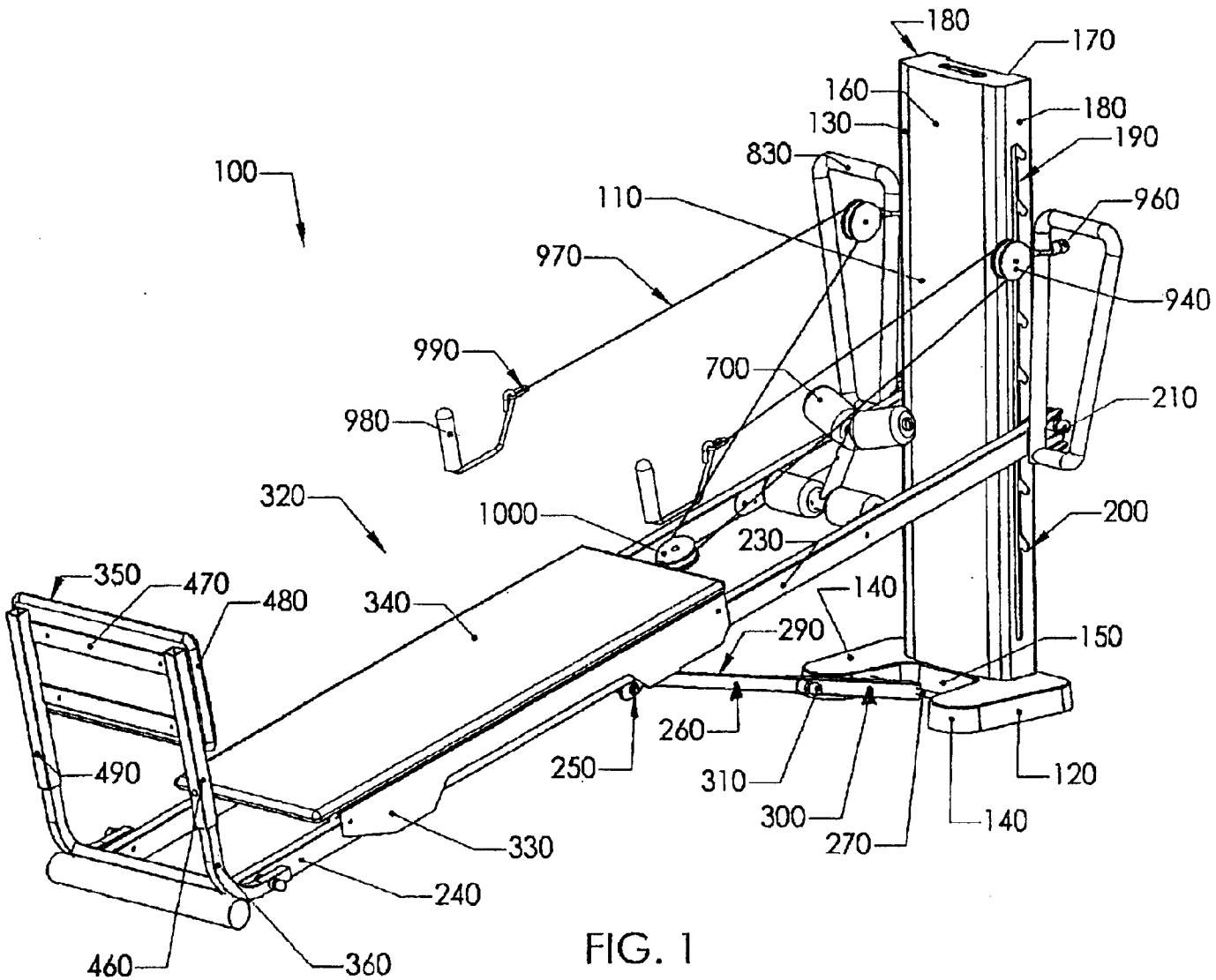
FIG. 1 is a perspective view of an embodiment of an exercise device.
Figure 2:
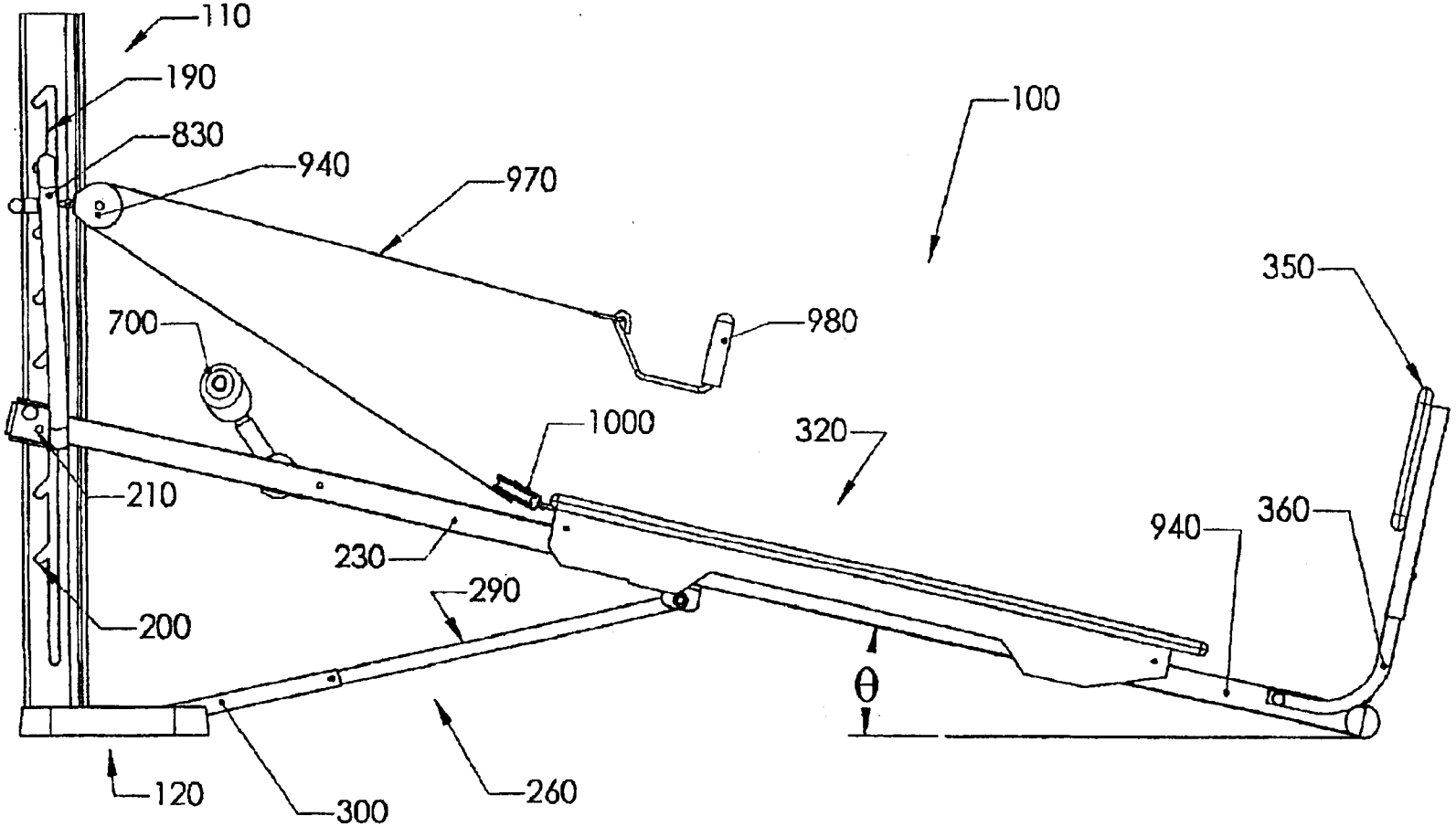
FIG. 2 is a left side elevational view of the exercise device shown in FIG. 1.
Figure 3:
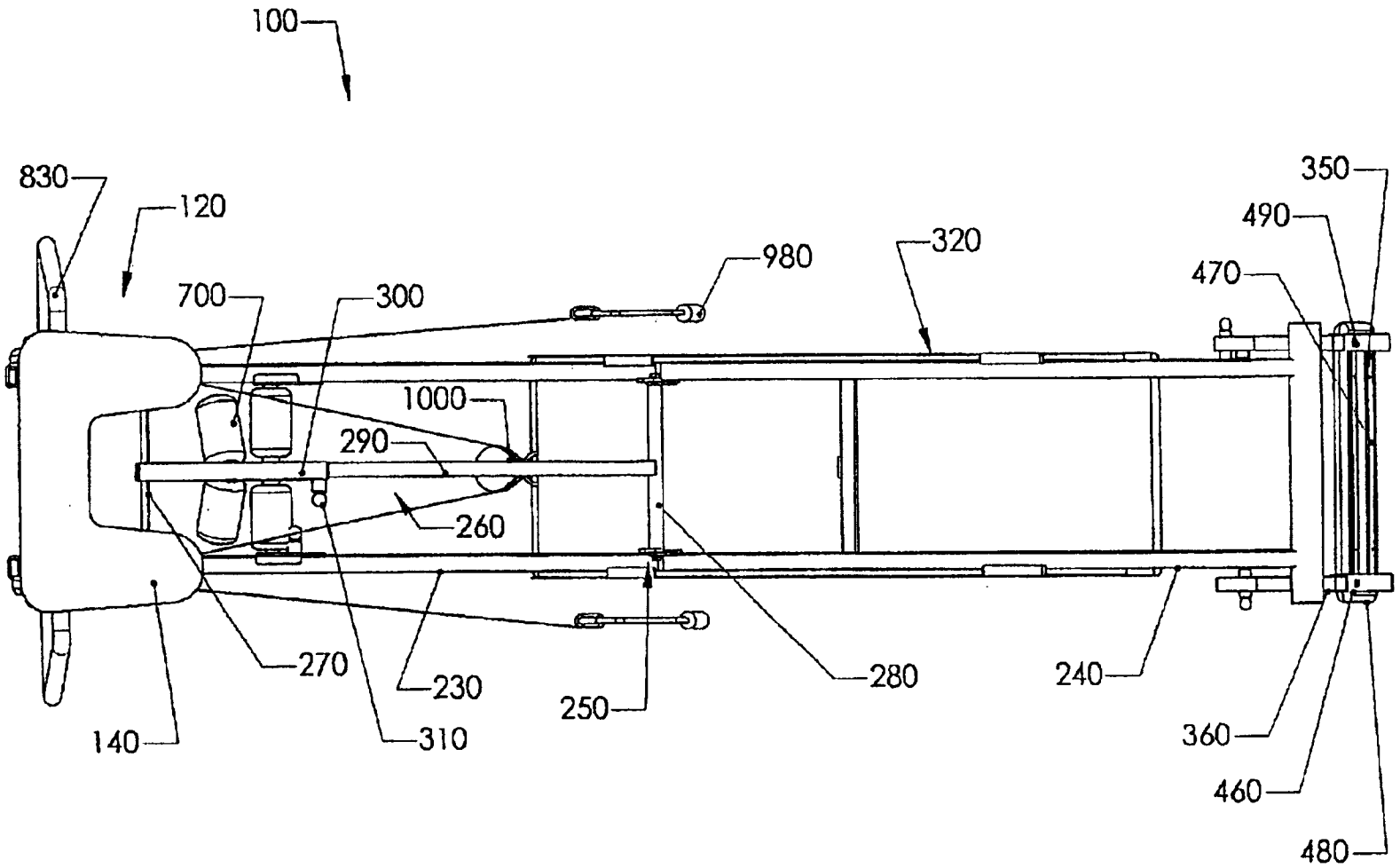
FIG. 3 is a bottom plan view of the exercise device shown in FIG. 1.

With reference to FIGS. 1–3, a collapsible exercise device 100 constructed in accordance with an embodiment of the invention will now be described. The collapsible exercise device 100 is shown in an unfolded state. The collapsible exercise device 100 includes a vertical support member or tower 110 having a base 120 and a tower housing 130. The base 120 includes a pair of opposite foot-shaped base members 140 joined by an intermediate base section 150. The tower housing 130 extends from the intermediate base section 150 of the base 120. The tower housing 130 includes a front vertical face 160, a rear vertical face 170, and opposite symmetric sides 180. The sides 180 include tower level tracks 190 with multiple tower level hooks 200 evenly vertically spaced along the tracks 190.

Slide bars 210 extend inwardly from proximal ends 220 of a pair of upper rails 230. The inwardly extending slide bars 210 may be slid up or down in the tower level tracks 190 and set in corresponding tower level hooks 200 to a desired height. The slide bars 210 may be removable from the upper rails 230. A pair of lower rails 240 are pivotally connected to the upper rails 230 at rail pivot points 250. A strut 260 is pivotally connected to the base 120 through a lower pivot bar 270 at the base members 140 and is also pivotally connected to the rail pivot points 250 through an upper pivot bar 280. The strut 260 includes an upper strut post 290 matingly received within a lower strut post 300. The strut posts 290 may be locked with respect to each other with a spring-loaded pull pin 310 and lateral holes in the upper strut post 290.

In an alternate embodiment, one end of the strut 260 may be pivotally connected to the upper pivot bar 280, while the other end includes a support platform that rests on a floor.

A user support platform 320 is slidably attached to the rails 230, 240 through support frame or glide board 330 and rollers (not shown) on the support frame 330. A main support pad 340 is attached to and supported by the support frame 330. A bumper (not shown) may be positioned on the lower rails 240 to prevent the user support platform 320 from rolling all the way down the lower rails 240.

Figures 4A, 4B:
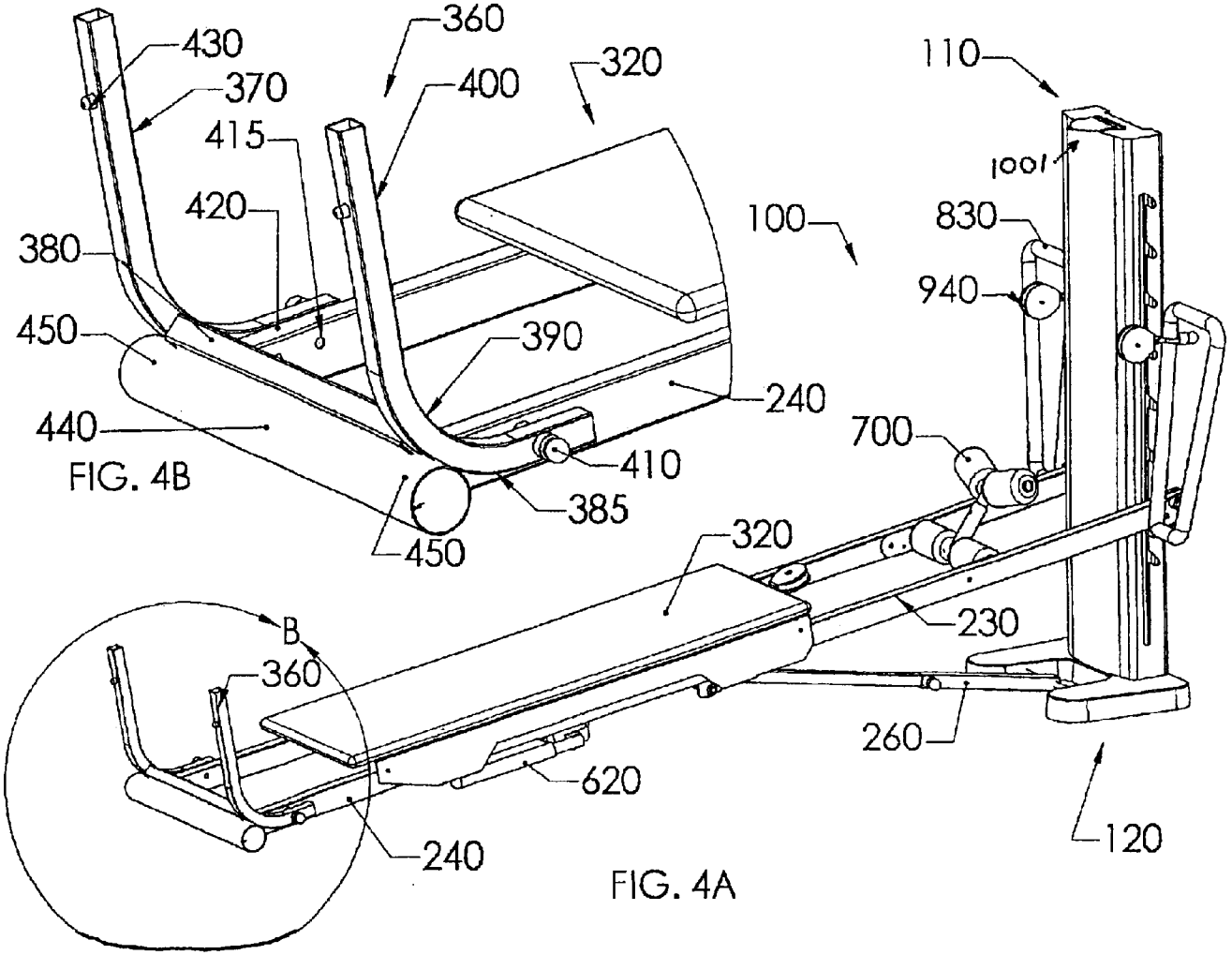
FIG. 4A is a perspective view of the device shown in FIG. 1 with a telescoping squat stand removed from a folding squat platform and the folding squat stand shown in an unfolded state.
FIG. 4B is an enlarged perspective view of the area B of FIG. 4A and details the telescoping squat stand removed from a folding squat platform.

With reference to FIGS. 1, 2, and 4A–5B, a telescoping squat stand 350 and folding squat platform 360 constructed in accordance with an embodiment of the invention will be described. In FIGS. 4A and 4B, the folding squat platform 360 is shown in an unfolded state with the telescoping squat stand 350 removed from the folding squat platform 360. The folding squat platform 360 includes opposite parallel rails 370 joined by perpendicularly extending cross rail 380. Each rail 370 has a generally square cross-section and includes a short, straight pivot portion 385, a curved portion 390, and an elongated distal portion 400. The pivot portion 385 carries a spring-loaded pull pin 410 for locking the folding squat platform 360 within pin holes 415 near a distal end 420 of the lower rails 240. A spring-loaded depressible pin 430 is carried in the elongated distal portion 400 for locking the folding squat platform 360 in place along the folding squat platform 360.

In the unfolded state shown in FIGS. 4A and 4B, the curved portion 390 of the rails 370 and the cross rail 380 are supported by a cross member 440. The cross member 440 has a generally cylindrical configuration and extends perpendicularly between the distal ends 420 of the lower rails, joining the lower rails 240. Ends 450 of the cross member 440 extend laterally beyond the distal ends 420 and may carry rollers or wheels for rolling this part of the exercise device 100 along the floor.

Figures 5A, 5B:
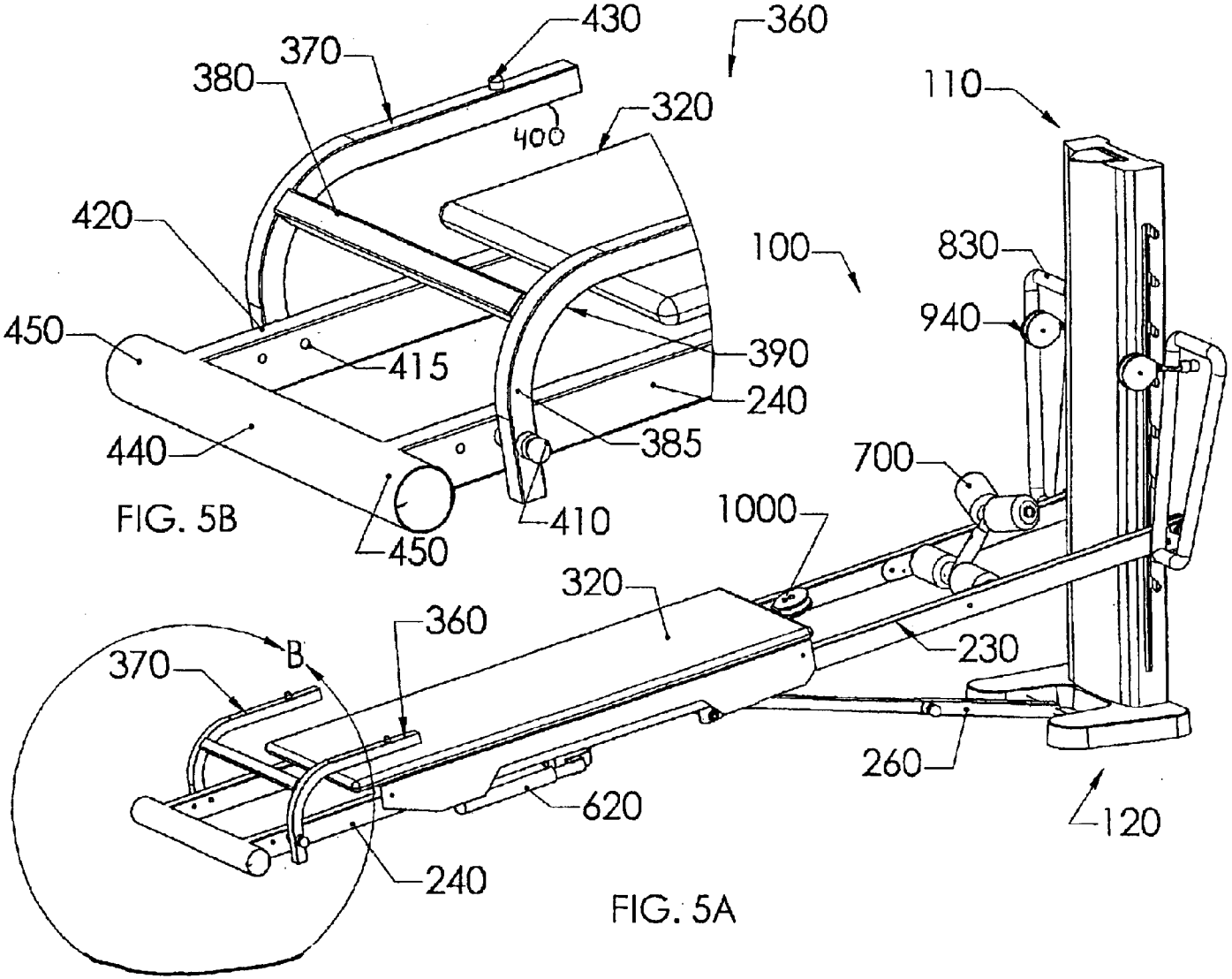
FIG. 5A is a perspective view of the device shown in FIG. 1 with a telescoping squat stand removed from a folding squat platform and the folding squat stand shown in a folded state.
FIG. 5B is an enlarged perspective view of the area B of FIG. 5A and details the folding squat platform shown in a folded state.

The folding squat platform 360 may be pivoted or folded up to the compact position shown in FIGS. 5A and 5B, where the elongated distal portion 400 of the folding squat platform 260 is generally parallel with the lower rails 240. The telescoping squat stand 350 includes opposite straight parallel rails 460, perpendicularly extending supports 470, and a squat platform 480 supported by and connected to the rails 460 and supports 470. The rails 460 include a generally square cross-sectional, hollow configuration and telescope onto (matingly receive) the elongated distal portions 400 of the rails 370. When attaching the squat stand 350 to the rails 370, the pins 430 may be depressed slightly to allow the rails 460 to slide completely onto the rails 370. Each rail 460 may include one or more pin holes 490 that the spring-loaded pin 430 snap locks into when the hole 490 is over the pin 430. The telescoping squat stand 350 may be removed by pressing down on the pins 430 and sliding the rails 460 of the squat stand 350 off of the rails 370 of the folding squat platform 360. The folding squat platform 360 (or the folding squat platform 260 and connected squat stand 350) may be removed from the distal ends of the lower rails 240 by pulling the pull pins 410 out of the pin holes 415 and removing the folding squat platform 360 from the lower rails 240.

Figures 5C, 5D:
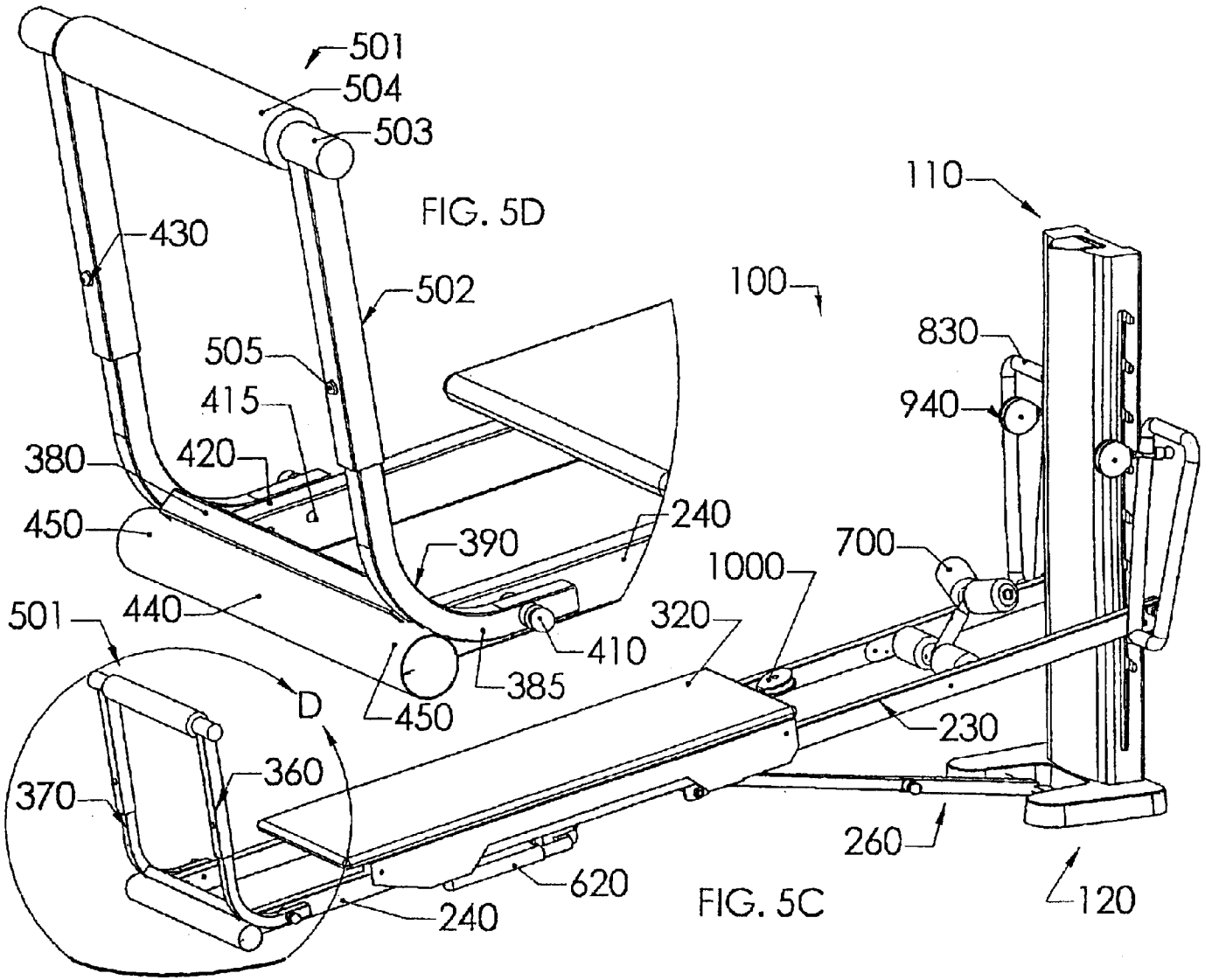
FIG. 5C is a perspective view of the device shown in FIG. 1 with a telescoping squat stand removed from the folding squat platform and an embodiment of a toe bar accessory attached to the folding squat stand.
FIG. 5D is an enlarged perspective view of the area D of FIG. 5C and details the toe bar accessory and the folding squat stand in an unfolded state.

FIGS. 5C and 5D illustrate an embodiment of a telescoping toe bar accessory 501 that attaches to the folding platform 360 in the same manner as the telescoping squat stand 350. The toe bar accessory 501 includes opposite straight parallel rails 502, perpendicularly extending toe bar 503, and a cylindrical toe pad or cushion 504 that surrounds a central portion of the toe bar 503. The rails 502 include a generally square cross-sectional, hollow configuration and telescope onto (matingly receive) the elongated distal portions 400 of the rails 370. When attaching the toe bar accessory 501 to the rails 370, the pins 430 may be depressed slightly to allow the rails 502 to slide completely onto the rails 370. Each rail 502 may include one or more pin holes 505 that the spring-loaded pin 430 snap locks into when the hole 505 is over the pin 430. The telescoping toe bar accessory 501 may be removed by pressing down on the pins 430 and sliding the rails 502 of the toe bar accessory 501 off of the rails 370 of the folding platform 360. The folding platform 360 (or the folding platform 260 and connected toe bar accessory 501) may be removed from the distal ends of the lower rails 240 by pulling the pull pins 410 out of the pin holes 415 and removing the folding platform 360 from the lower rails 240.

Figures 6A, 6B:
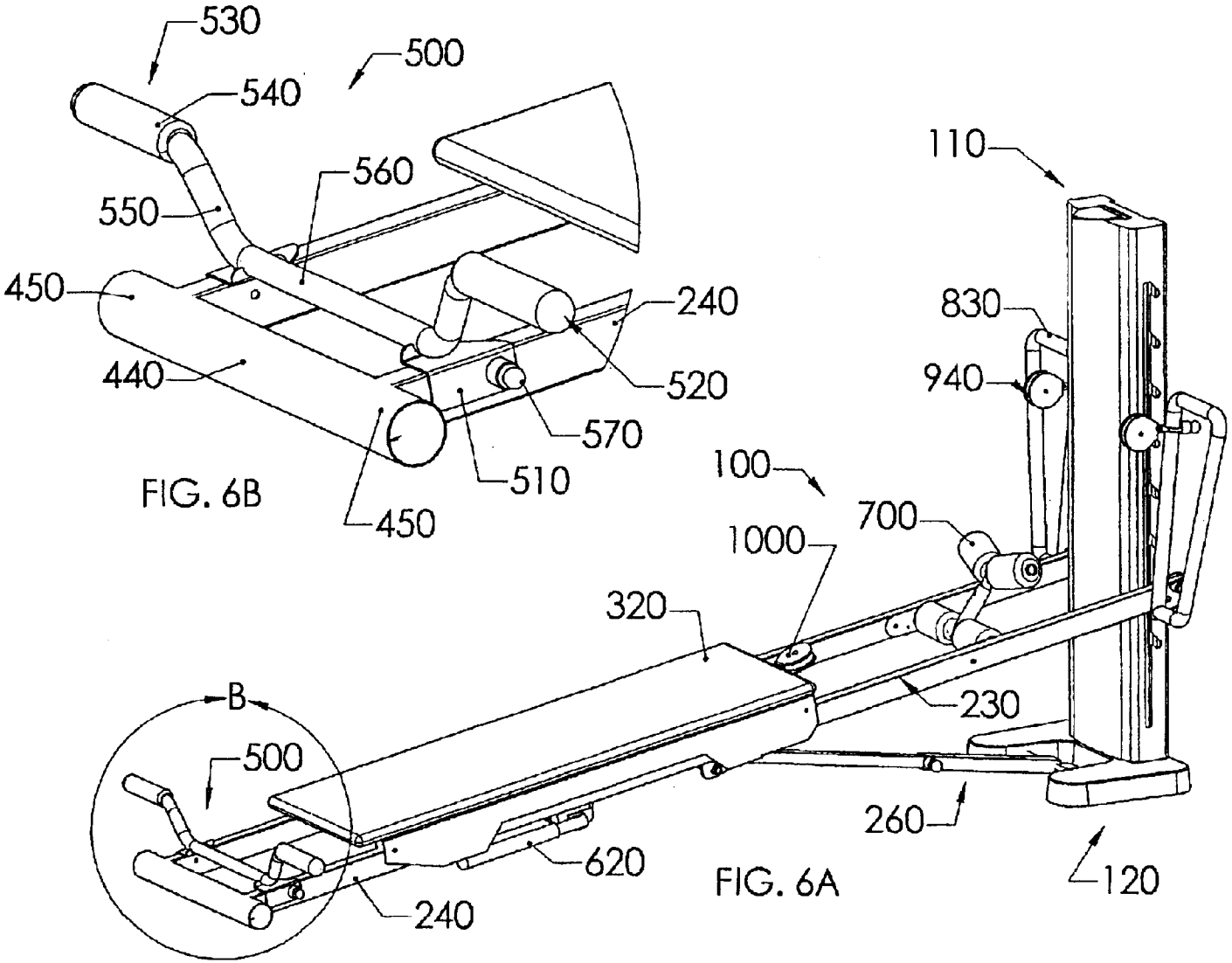
FIG. 6A is a perspective view of the device shown in FIG. 1 with the telescoping squat stand and folding squat platform replaced with a push-up bar accessory.
FIG. 6B is an enlarged perspective view of the area B of FIG. 6A and details the push-up bar accessory.

With reference to FIG. 6A, an embodiment of a push-up bar accessory 500 that may be easily attached to and removed from the distal ends 420 of the lower rails 240 will now be described. The push-up bar accessory 500 includes a pair of opposite coupling brackets 510 for connecting the push-up bar accessory 500 to the distal ends 420 of the lower rails 240. A push-up bar 520 includes handles 530 with grips 540, upwardly angled portions 550, and intermediate portion 560. The push-up bar 520 is connected to the brackets 510 near where the intermediate portion 560 joins the angled portions 550. The brackets 510 carry spring-loaded pull pins 570 for attaching the push-up bar accessory 500 to and removing it from pin holes 415 at the distal ends 420 of the lower rails 240.

Figures 7A, 7B:
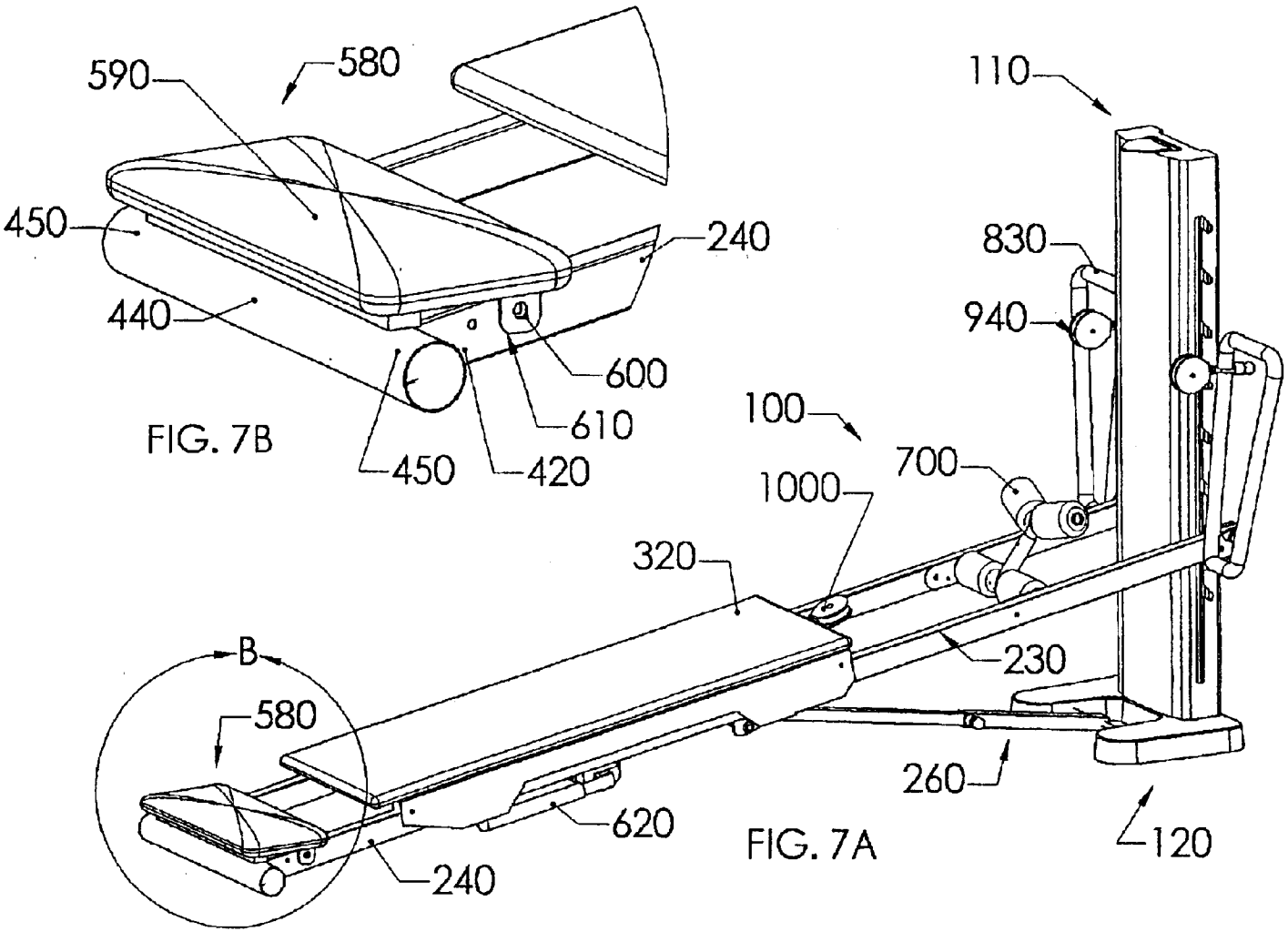
FIG. 7A is a perspective view of the device shown in FIG. 1 with the telescoping squat stand and folding squat platform replaced with a padded foot support accessory.
FIG. 7B is an enlarged perspective view of the area B of FIG. 7A and details the padded foot support accessory.
Figures 8A, 8B:
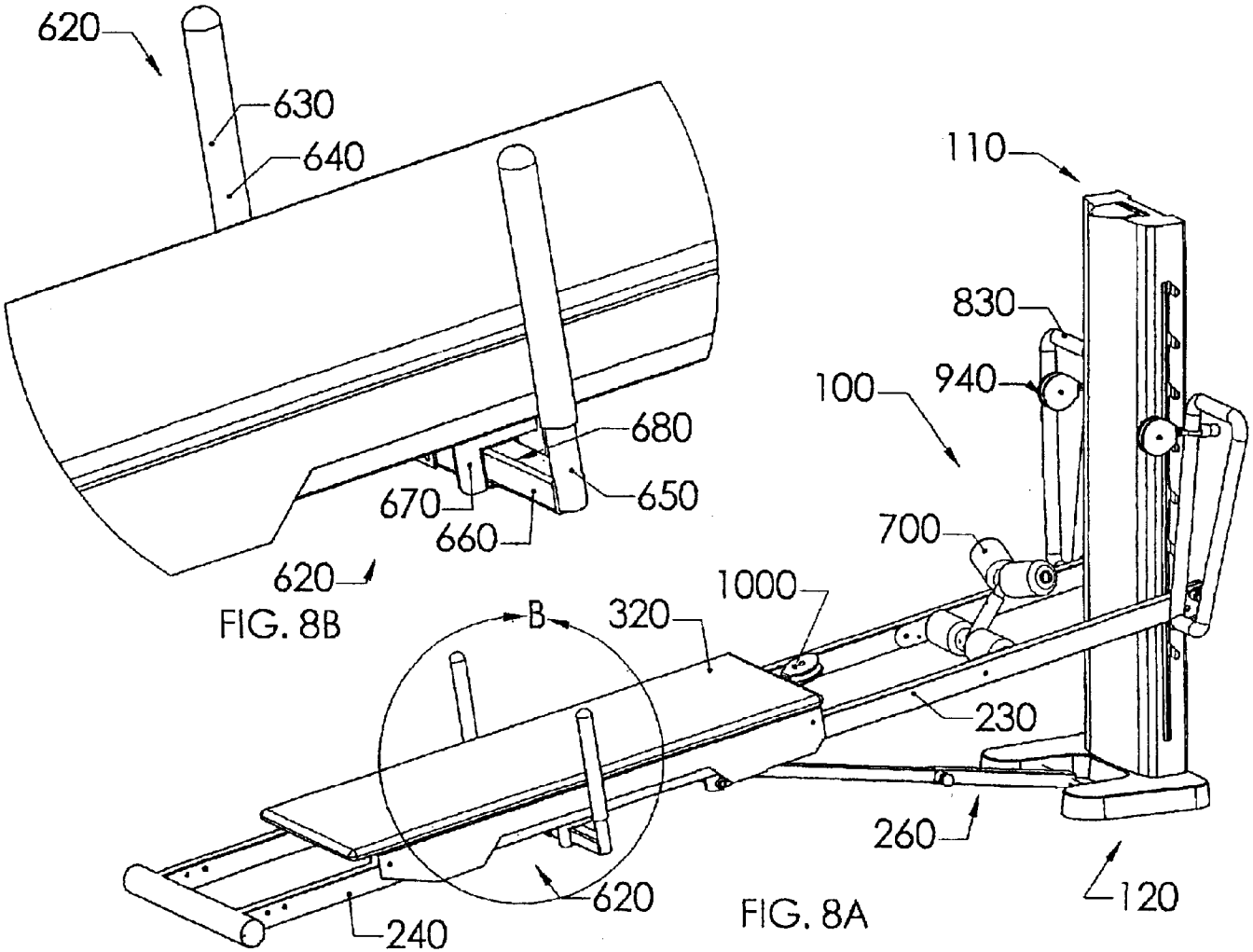
FIG. 8A is a perspective view of the device shown in FIG. 1 without the telescoping squat stand and folding squat platform and shows a dip bar accessory in an retracted state.
FIG. 8B is an enlarged perspective view of the area B of FIG. 8A and details the dip bar accessory.
Figures 9A, 9B:
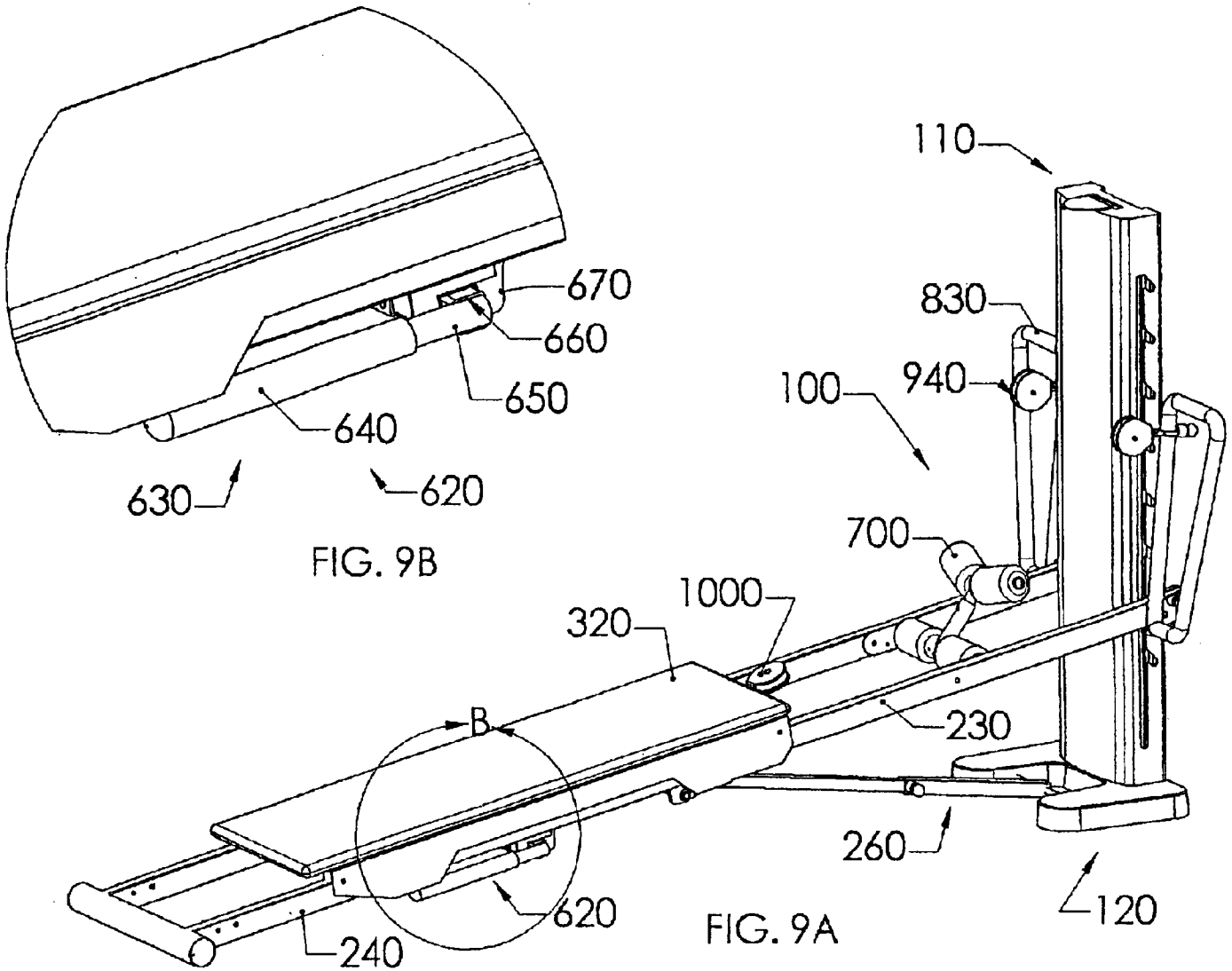
FIG. 9A is a perspective view of the device similar to FIG. 9A and shows the dip bar accessory in a unretracted state.
FIG. 9B is an enlarged perspective view of the area B of FIG. 9A and details the dip bar accessory in a retracted state.
Figures 10A, 10B:
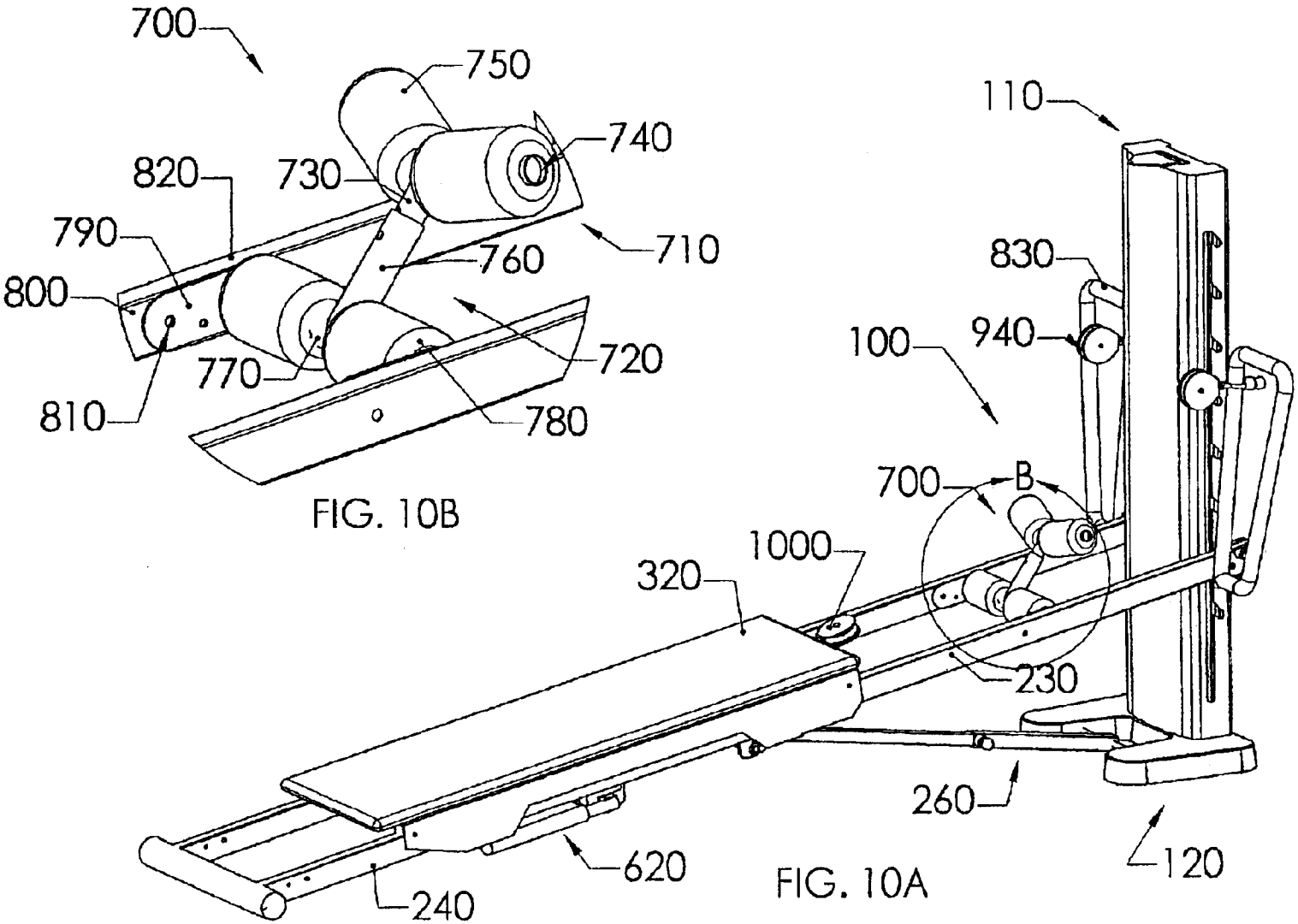
FIG. 10A is a perspective view of the device shown in FIG. 1 and shows a folding foot platform in an unfolded state.
FIG. 10B is an enlarged perspective view of the area B of FIG. 10A and details the foot platform.
Figures 11A, 11B:
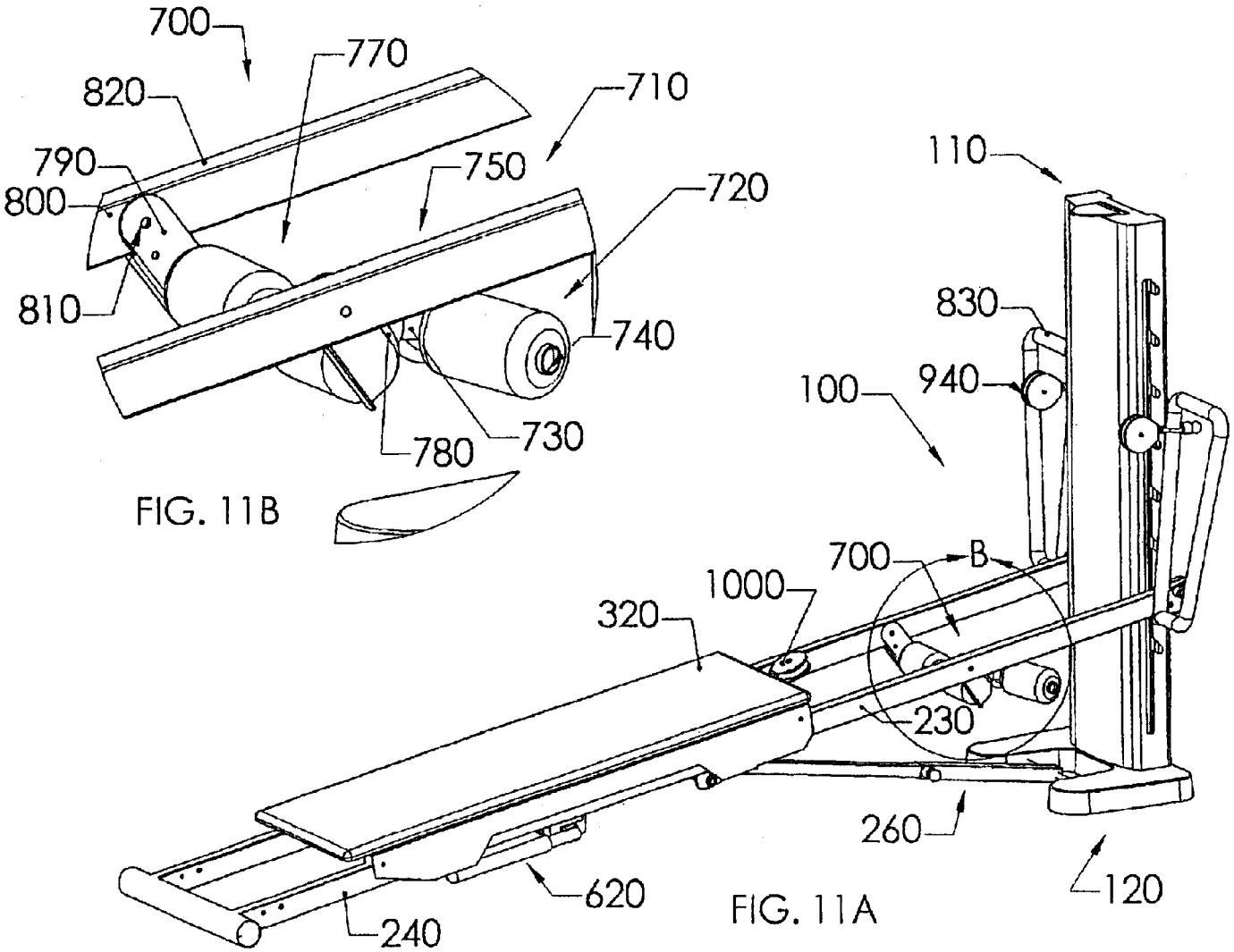
FIG. 11A is a perspective view of the device similar to FIG. 10A and shows the folding foot platform in a folded state.
FIG.11B is an enlarged perspective view of the area B of FIG. 11A and details the folding foot platform in a folded state.

With reference to FIGS. 7A and 7B, an embodiment of a padded foot support accessory 580 that may be easily attached to and removed from the distal ends 420 of the lower rails 240 will now be described. The padded foot support accessory 580 includes a foot pad 590 supported by and connected to opposite brackets 600 for connecting the padded foot support accessory 580 to the distal ends 420 of the lower rails 240. The brackets 600 carry spring-loaded pull pins 610 for attaching the padded foot support accessory 580 to and removing it from pin holes 415 at the distal ends 420 of the lower rails 240. In the position shown, the padded foot support accessory 580 is supported by the brackets 600 on the lower rails 240 and the cross member 440.

With reference to FIGS. 8A–9B, an embodiment of a dip bar accessory 620 that may be used with the exercise device 100 will now be described. The dip bar accessory 620 includes handles 630 with grips 640 attached at ends 650 to perpendicularly extending cross rails 660. The handles 630 may have a generally cylindrical, tubular configuration and the cross rails 660 may have a generally square cross-sectional, hollow configuration. The cross rails 660 slide laterally in and out within brackets 670 mounted to the lower rails 240. The brackets 670 have rectilinear cut outs 680 that the cross rails 660 slide within. A locking mechanism (not shown) of the brackets 670 (or as one or more separate members) allow the handles 630 to be moved laterally outward and rotated 90 degrees upward to the unretracted state shown in FIGS. 8A and 8B, and moved laterally inward and rotated 90 degrees downward to the retracted state shown in FIGS. 9A and 9B. In the unretracted, active state shown in FIGS. 8A and 8B, the cross rails 660 are low enough and the handles 630 are disposed laterally outward far enough so as to avoid contact with the support frame 330 of the user support platform 320 when the platform 320 is in motion. In the retracted state shown in FIGS. 9A and 9B, the handles 630 are disposed beneath and parallel to the lower rails 240. In this position, the handles 630 are also are disposed laterally inward far enough so as to avoid contact with the support frame 330 of the user support platform 320 when the platform 320 is in motion.

With reference to FIGS. 10A–11B, an embodiment of a folding foot platform 700 that may positioned in an unretracted or unfolded state (FIGS. 10A, 10B) and a retracted or folded state (FIGS. 11A, 11B) will now be described. The folding foot platform 700 includes a generally Y-shaped member 710 telescoped within an upside-down generally T-shaped member 720. The generally Y-shaped member includes a cylindrical main insertion tube 730 and upwardly angled foot retaining tubes 740. Cylindrical toe cushions 750 cover the upwardly angled foot retaining tubes 740. The upside-down generally T-shaped member 720 includes a main receiving tube 760 and outwardly perpendicularly extending cylindrical heel support tubes 770. Cylindrical heel cushions 780 cover the heel support tubes 770. The main insertion tube 730 is slidably received within the main receiving tube 760 and may be locked relative thereto with a pull pin within holes in the tubes 730, 760. Outer lateral ends of the heel support tubes 770 are fixedly connected to pivoting brackets 790. The pivoting brackets 790 are pivotally connected to inner sides 800 of the upper rails 230 through pivot pins 810. In the unretracted state shown in FIGS. 10A, 10B, a user may position his or her feet into the folding foot platform 700 by putting toes underneath the toe cushions 750 and heels on the heel cushions 780. The brackets 790, and, hence, the folding foot platform 700, are prevented from pivoting farther upward than the state shown in FIGS. 10A and 10B by an upper flange 820 of the upper rails 230. When not in use, the folding foot platform 700 may be pivoted or folded to an out-of-the-way, retracted or folded state shown in FIGS. 11A, 11B.

Figures 12A, 12B:
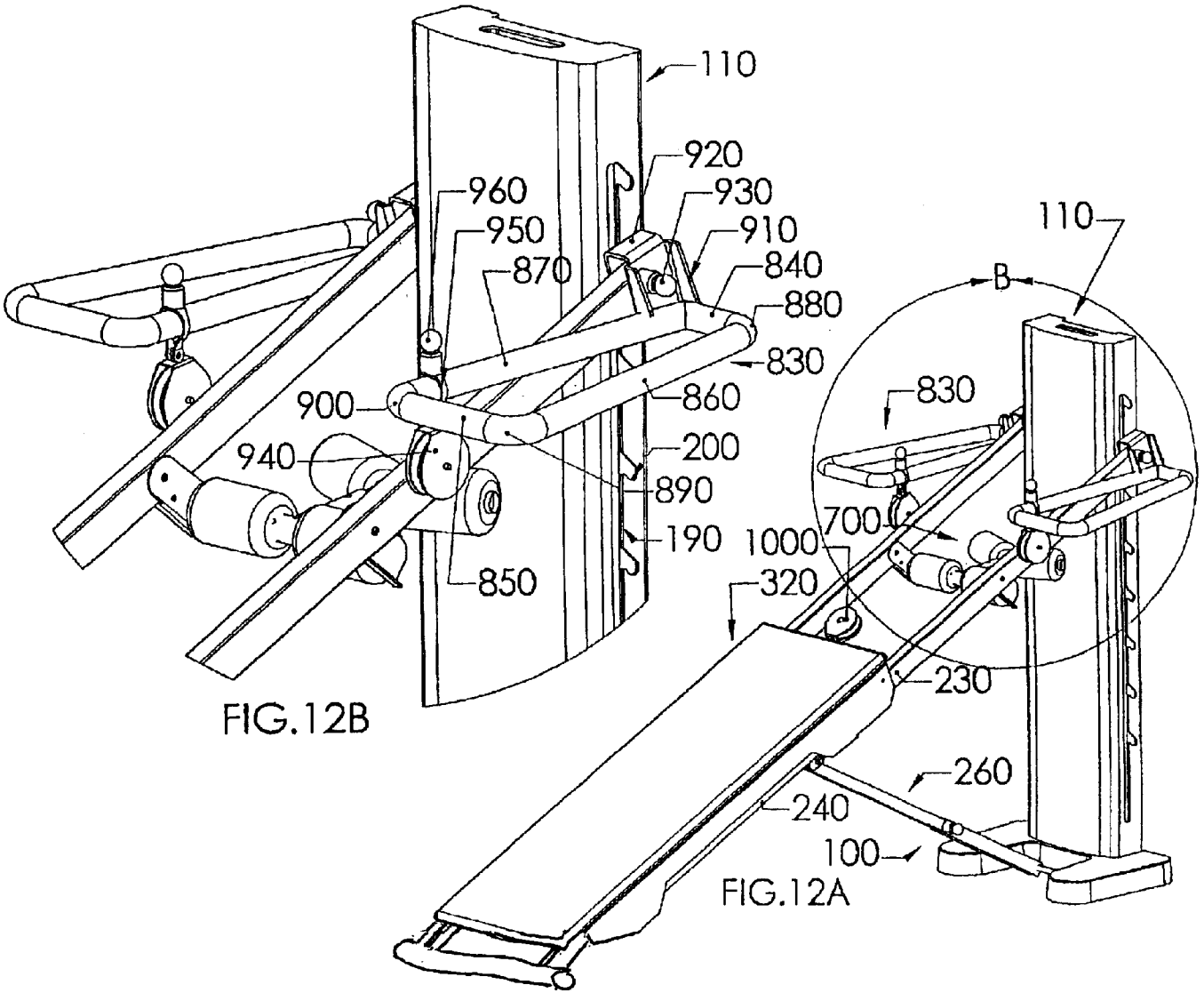
FIG. 12A is a perspective view of the device shown in FIG. 1 and shows folding, combination pulley-support and pull-up bars in a folded down or pull-up state.
FIG. 12B is an enlarged perspective view of the area B of FIG. 12A and details the folding, combination pulley-support and pull-up bars in a folded down or pull-up state.

With reference to FIGS. 1, 12A, and 12B, an embodiment of folding, combination pulley-support and pull-up bars 830 will now be described. In the embodiment shown, each bar 830 has a trapezoidal configuration and includes the following main sections: a short, straight, proximal tubular section 840, a straight, distal tubular section or pull-up handle 850 parallel to and longer than the proximal tubular section 840, an elongated, straight, angled, outer tubular section 860, and an elongated, straight, inner tubular section 870 perpendicular to the proximal tubular section 840 and the distal tubular section 850. An outer end of the proximal tubular section 840 is connected to a proximal end of the outer tubular section 860 by a tubular proximal outer elbow 880. An outer end of the distal tubular section 850 is connected to a distal end of the outer tubular section 860 by a tubular distal outer elbow 890. An inner end of the distal tubular section 850 is connected to a distal end of the inner tubular section 870 by a tubular distal inner elbow 900. An inner end of the proximal tubular section 840 is connected to a proximal end of the inner tubular section 870 by a pivoting bracket 910. The pivoting bracket 910 is pivotally connected to an attachment bracket 920, which is attached to the proximal end 220 of the upper rails 230. The pivoting bracket 910 carries a spring-loaded pull pin 930. The attachment bracket 920 may include a vertical pin hole, a horizontal pin hole, and a collapsing pin hole.

For normal use, the bars 830 may be moved to the position shown in FIG. 1 and locked into place using the pull pin 930 and the vertical pin hole on the attachment bracket 920. For performing chin ups, the bars 830 may be moved to the position shown in FIGS. 12A, 12B and locked into place using the pull pin 930 and the horizontal pin hole on the attachment bracket 920. For collapsing the exercise device 100, the bars 830 may be moved to the position shown in FIG. 13, where the bars 830 are parallel to the upper rails 230 and locked into place using the pull pin 930 and the collapsing pin hole on the attachment bracket 920.

Pulleys 940 are slidably attached to the bars 830. Each pulley 940 includes a collar 950 and a spring-loaded pull pin 960. An exerciser may move each pulley 940 to a desired position on the bar 830 by pulling on the pull pin 960, sliding the pulley 940 via the collar 950 to a desired position on the bar 830, and releasing the pull pin 960 to lock the pulley 940 in place on the bar 830. It should be noted, the pulley 940 may be slid onto sections or elbows other than the inner tubular section 870.

A connector extends through the pulleys 940 and connects to the user support platform 320. The connector may be of any suitable well-known type, but shown by way of example 1 is a cable 970. The cable 970 includes handles 980 (connected via links 990) at each end and extends through the pulleys 940 positioned on the combination pulley-support and pull-up bars 830 and loops through a third pulley 1000 attached to the user support platform 320. The third pulley 1000 is positioned along the lateral centerline of the user support platform 320. This position allows for unilateral (i.e. one arm), bilateral (i.e., two arm) and static equilibrium (i.e. holding the user support platform 320 suspended by keeping a constant force on each handle 980) use.

The cable 970 and the handles 980 may hang from attachment member 1001 (FIG. 4A) when not in use for storage purposes. The attachment member 1001 may also be used for connecting a separate pulley and leg ankle cuff.

The cable 970 should preferably be of sufficient length to extend through the pulleys 940 and allow the exerciser to grasp one or both of the handles 980 while the exerciser is on the user support platform 320 and the user support platform 320 is at rest.

In an alternate embodiment, the connector may be two separate cables extending through the pulleys 940 with each cable fixedly attached to the user support platform 320.

Figure 13:
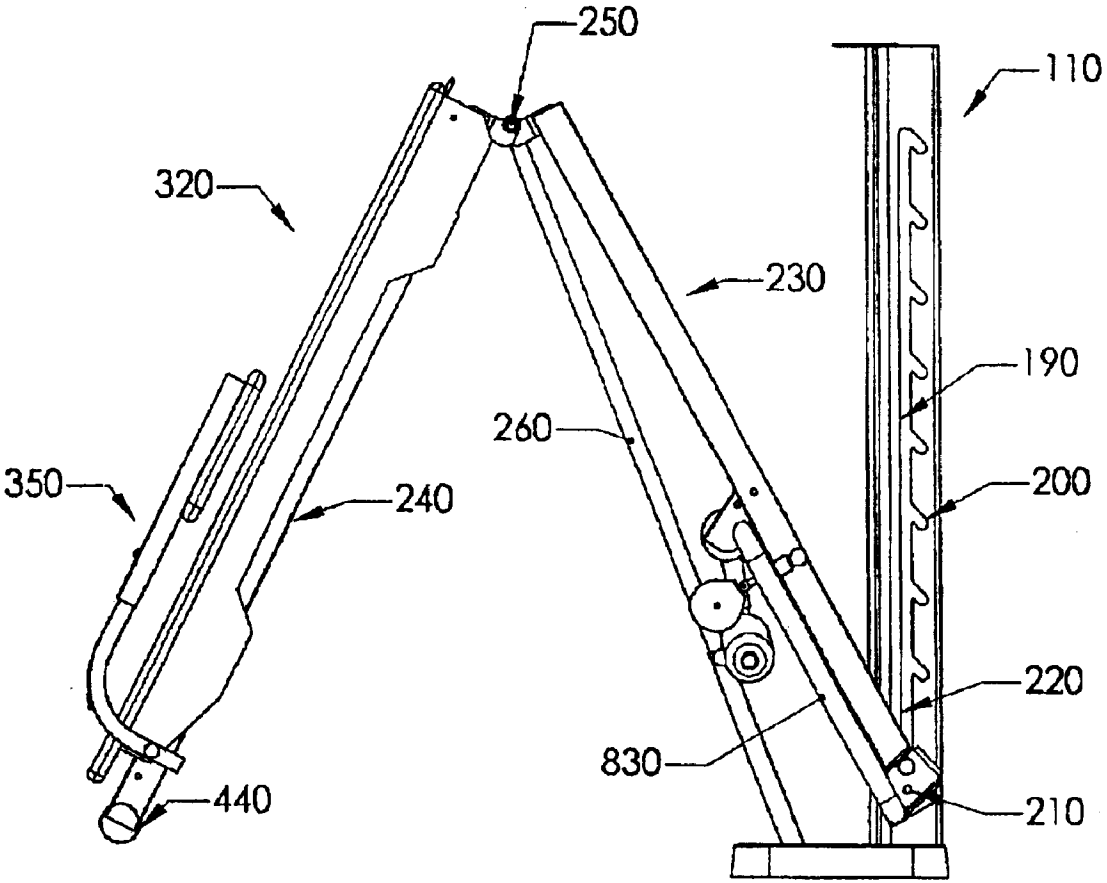
FIG. 13 is a right side elevational view of the exercise device shown in FIG. 1 in a semi-folded state.
Figure 14:
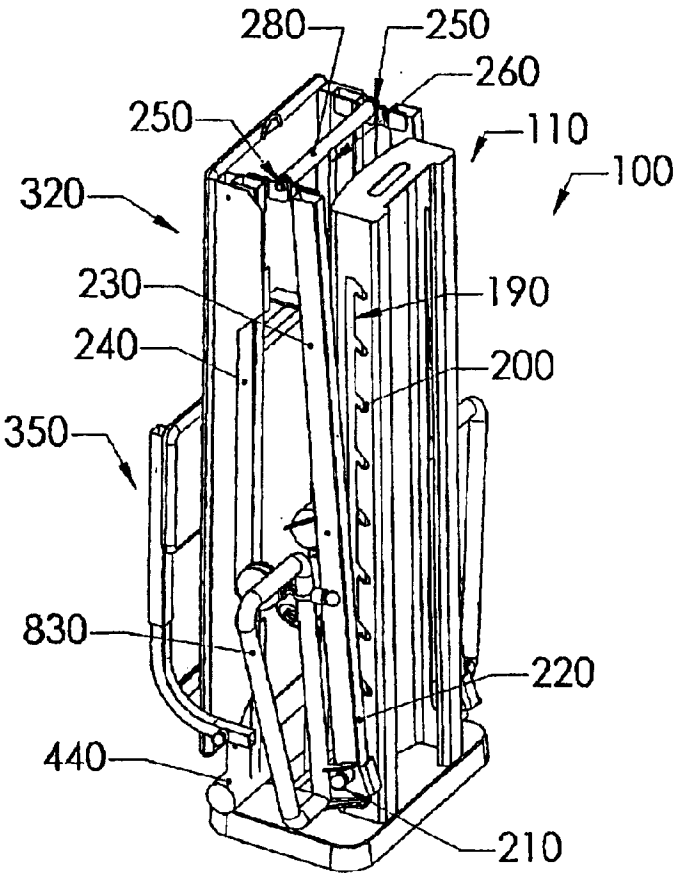
FIG. 14 is a rear perspective view of the exercise device shown in FIG. 1 in a folded state.

With reference to FIGS. 13 and 14, the collapsible or foldable nature of the exercise device 100 will now be described. FIG. 13 shows the collapsible exercise device 100 in a semi-folded state. The slide bars 210 at the proximal ends 220 of the upper rails 230 are lowered to the bottom of the tower level tracks 190 of the vertical support tower 110, and the squat stand 350 is folded over onto the user support platform 320. The rail pivot points 250 and the upper pivot bar 280 are then drawn up away from the floor while rollers on the cross member 440 roll along the floor. The exercise device 100 continues to be folded until the vertical support tower 110, the strut 260, the upper rails 230, the lower rails 240, the user support platform 320, the squat stand 350, and the combination pulley-support and pull-up bars 830 are substantially parallel as shown in FIG. 14. It should be noted that in this position, the user support platform 320 may be rolled up the lower rails 240 and off of the collapsed exercise device 100. To unfold the exercise device 100, the rollers on the cross member 440 at distal ends 420 of the lower rails 240 are rolled along the floor away from the vertical support tower 110. Once the upper rails 230 and the lower rails 240 are extended along the floor 52, the slide bars 210 at the proximal ends 220 of the upper rails 230 are raised via the proximal ends 220 of the upper rails 230 just above a desired height and lowered into tower level hooks 200 at the desired height. The squat stand 350 may then be folded to the position shown in FIG. 1.

In use, the exerciser positions himself or herself on the user support platform 320 and grasps one or both of the handles 980. The exerciser then draws one or both of the handles 980 toward the exerciser and by doing so transports the user support platform 320 up along the lower rails 240 and upper rails 230.

By varying the height of the proximal ends 220 of the upper rails 230 on the tower level hooks 200 of the vertical support tower 110, the angle θ (shown in FIG. 2) may be adjusted. The adjustment of this angle θ alters the percentage of the exerciser's weight which the exerciser's muscles are moving. This allows for adjustment of the intensity of the exerciser's workout. Weight bars (not shown) may be added to the user support platform 320 so that weight plates (not shown) may be positioned on the weight bars, thus adding to the weight propelled by the exerciser's muscles.

The exerciser may vary the position of the pulleys 940 on the combination pulley-support and pull-up bars 830 in the manner described above. For example, the pulleys 940 may be raised or lowered on the inner tubular sections 870 so that the handles 980 and pulling motion are at a more comfortable orientation or to work different muscle groups. The pulleys 940 may be moved to the outer tubular sections 860 (or other sections) for a wider grip and motion of the handles 980 or to work different muscle groups.

An exerciser may also vary the resistance while working upper body muscles by positioning him or herself on the user support platform 320 with the exerciser's feet on the squat stand 350 or floor. The legs and lower body then provide assistance in moving the user support platform 320, lessening the load on the upper body muscles. The exerciser may also use the squat stand 350 to perform the squat exercise for the lower body muscles.

In an alternate embodiment, an exerciser may lie on the user support platform 320 with the exerciser's feet positioned in the foot platform 700 as described above. By bending the exerciser's legs, the exerciser draws the user support platform 320 up along the rails 230, 240. The exercise may also perform sit ups on the user support platform 320 by securing his or her legs in the foot platform 700. In this embodiment, the squat stand 350 and folding platform 260 may be replaced with the padded foot support accessory 580 to support the feet.

In a further embodiment, the squat stand 350 and folding platform 260 may be replaced with the push-up bar accessory 500. The exerciser performs push ups using the push-up bar accessory 500 with his or her feet on the floor, and the chest over the distal part of the lower rails 240. The exerciser may also lie on the user support platform 320 and use the push-up bar accessory 500 to perform a military press or similar exercise.

In another embodiment, the exerciser may lie on the user support platform 320, grip the handles 630 of the dip bar accessory 620 (FIGS. 8A, 8B), and perform dips, exercising the arms and chest.

Furthermore, an exerciser may lower the combination pulley-support and pull-up bars 830 to the position shown in FIGS. 12A, 12B as described above, position himself or herself on the user support platform 320, and grasp the handles 850. By drawing the exerciser toward the handles 850, the exerciser is exercising additional muscle groups.

It will be apparent to those skilled in the art that various modifications and variations can be made in the collapsible exercise device 100 described above without departing from the spirit or scope of the invention. Thus, it is intended that the present invention cover the modifications and variations of this invention provided they come within the scope of the appended claims and their equivalents.

What is claimed is:

1. A collapsible exercise device, comprising:

a vertical support member;

a first set of rails, each of the first set of rails having a first end and a second end, the first end of each of the first set of rails being pivotally connected to, and adjustably supported by, the vertical support member;

a second set of rails, each of the second set of rails having a first end and a second end, the first end of each of the second set of rails being pivotally connected to the second end of the first set of rails;

a strut with a first end and a second end, the first end of the strut being pivotally connected to the vertical support member and the second end of the strut being pivotally connected to the rails where the rails are pivotally connected to each other;

a user support platform with rollers engaging the first and second set of rails, first and second combination pulley-support and pull-up bars each pivotally connected to the first end of the first set of rails for movement between at least a substantially vertical position and a substantially horizontal position where the combination pulley-support and pull-up bars are used for performing pull-ups;

first and second pulleys slidably connected to the first and second combination pulley-support and pull-up bars for slidable movement of the pulleys to a desired location; and one or more cables extendable through first and second pulleys and connected to the user support platform;

wherein the exercise device is foldable such that the vertical support member, the first set of rails, the second set of rails and the strut are substantially parallel to each other; and wherein the first and second set of rails are extendable from the vertical support member and are alignable such that the user support platform is rollable along the first and second rails.

2. A collapsible exercise device as claimed in claim 1, wherein the first and second combination pulley-support and pull-up bars each have a trapezoidal configuration.

3. A collapsible exercise device as claimed in claim 1, wherein the first and second pulleys each include a collar slidably attached to the combination pulley-support and pull-up bar and a pull pin carried by the collar for locking the pulley in position on the combination pulley-support and pull-up bar.

4. A collapsible exercise device as claimed in claim 1, further comprising a folding squat platform pivotally and removably connected to the second end of the second set of rails.

5. A collapsible exercise device as claimed in claim 4, further including a squat stand telescopingly and removably engaged with the folding squat platform.

6. A collapsible exercise device as claimed in claim 1, further comprising a push-up bar removably connected to the second end of the second set of rails.

7. A collapsible exercise device as claimed in claim 1, further comprising a padded foot support removably connected to the second end of the second set of rails.

8. A collapsible exercise device as claimed in claim 1, further comprising a dip bar assembly connected to the second set of rails, and the dip bar assembly including a pair of dip bars movable between at least a retracted, out-of-the way position, and a non-retracted, ready-for-use position.

9. A collapsible exercise device as claimed in claim 1, further comprising a foot support assembly pivotally connected to the first set of rails, and the foot support assembly pivotable between at least a retracted, out-of-the way position, and a non-retracted, ready-for-use position.

10. A collapsible exercise device as claimed in claim 1, wherein the strut is adjustable in length.

11. A collapsible exercise device as claimed in claim 1, wherein said one or more cables include a single cable with opposite ends, and handles each connected to the opposite ends of the single cable.

12. A collapsible exercise device as claimed in claim 1, wherein the vertical support member includes a vertical support tower including opposite sides with tower level tracks therein, the tower level tracks including multiple vertically spaced hooks, the first end of each of the first set of rails being pivotally connected to, and adjustably supported by opposite hooks of the tower level tracks.

* * * * *